US011244776B2

(12) United States Patent
Kura et al.

(10) Patent No.: US 11,244,776 B2
(45) Date of Patent: Feb. 8, 2022

(54) L10-FENI MAGNETIC POWDER AND BOND MAGNET

(71) Applicant: DENSO CORPORATION, Kariya (JP)

(72) Inventors: Hiroaki Kura, Kariya (JP); Eiji Watanabe, Kariya (JP); Masane Kin, Kariya (JP); Kenta Osanai, Kariya (JP)

(73) Assignee: DENSO CORPORATION, Kariya (JP)

( * ) Notice: Subject to any disclaimer, the term of this patent is extended or adjusted under 35 U.S.C. 154(b) by 176 days.

(21) Appl. No.: 16/672,865

(22) Filed: Nov. 4, 2019

(65) Prior Publication Data

US 2020/0066430 A1 Feb. 27, 2020

Related U.S. Application Data

(63) Continuation of application No. PCT/JP2018/018357, filed on May 11, 2018.

(30) Foreign Application Priority Data

May 17, 2017 (JP) ..... JP2017-098205

(51) Int. Cl.

| | |
|---|---|
| ***H01F 1/055*** | (2006.01) |
| ***B22F 1/00*** | (2006.01) |
| *H01F 1/057* | (2006.01) |
| *H01F 1/059* | (2006.01) |

(52) U.S. Cl.

CPC ..... *H01F 1/0551* (2013.01); *B22F 1/0018* (2013.01); *H01F 1/0558* (2013.01); *B22F 2301/15* (2013.01); *H01F 1/059* (2013.01); *H01F 1/0578* (2013.01)

(58) Field of Classification Search

None

See application file for complete search history.

(56) References Cited

U.S. PATENT DOCUMENTS

2014/0138569 A1 5/2014 Otsuka et al.
2018/0251867 A1* 9/2018 Kura ..... C21D 3/08

FOREIGN PATENT DOCUMENTS

JP H06-132107 A 5/1994
JP 2002-270419 A 9/2002
JP 2012-253247 A 12/2012
WO 2012/141205 A2 10/2012
WO WO-2017064989 A1 * 4/2017 ..... C23C 8/26

OTHER PUBLICATIONS

Gurmen, Journal of Alloys and Compounds, 2009, vol. 480, p. 529-533. (Year: 2009).*
U.S. Appl. No. 16/674,132, filed Nov. 5, 2019, Watanabe et al.
U.S. Appl. No. 16/677,755, filed Nov. 8, 2019, Saiga et al.
U.S. Appl. No. 16/678,344, filed Nov. 8, 2019, Goto et al.

* cited by examiner

*Primary Examiner* — Xiaowei Su
(74) *Attorney, Agent, or Firm* — Posz Law Group, PLC

(57) ABSTRACT

An L10-FeNi magnetic powder has an average particle size of 50 nm to 1 μm, and an average value of sphericity P of 0.9 or more. The sphericity P is defined as P=Ls/Lr, where Lr is a perimeter of an L10-FeNi magnetic powder particle on an image of a microscope, and Ls is a perimeter of a perfect circle that has a same area as the L10-FeNi magnetic powder particle on the image for which Lr is calculated.

4 Claims, 2 Drawing Sheets

L10-FENI MAGNETIC POWDER AND BOND MAGNET

CROSS REFERENCES TO RELATED APPLICATIONS

The present application is a continuation application of international Patent Application No PCT/JP2018/018357 filed on May 11, 2018, which designated the U.S. and claims the benefit of priority from Japanese Patent Application No. 2017-098205 filed on May 17, 2017. The entire disclosures of all of the above applications are incorporated herein by reference.

TECHNICAL FIELD

The present disclosure relates to an L10-FeNi magnetic powder and a bonded magnet.

BACKGROUND

Conventionally, a bonded magnet is known. The bonded magnet includes a base material and a magnetic power dispersed in the base material.

SUMMARY

The present disclosure provides an L10-FeNi magnetic powder. In one example, an L10-FeNi magnetic powder has an average particle size of 50 nm to 1 μm and an average value of sphericity P of 0.9 or more. The sphericity P is defined as P=Ls/Lr, where Lr is a perimeter of an L10-FeNi magnetic powder particle on an image of a microscope, and Ls is a perimeter of a perfect circle that has a same area as the L10-FeNi magnetic powder particle on the image for which Lr is calculated.

The present disclosure provides a bonded magnet. In one example, a bonded magnet comprises a base material and a magnetic powder dispersed in the base material. The magnetic powder may include the above L10-FeNi magnetic powder and a large-size magnetic powder having an average particle size of 1 μm to 500 μm. A mass percent of the L10-FeNi magnetic powder in the magnetic powder may be 5% or more.

DETAILED DESCRIPTION

A bonded magnet including a base material and a magnetic power dispersed in the base material may be manufactured by an injection molding or the like.

As a result of detailed studies by the inventors, the following issue has been found. When manufacturing a bonded magnet by injection molding, it is necessary to ensure the fluidity of a raw material. Moreover, it is necessary to increase a degree of orientation of the magnetic powder. When a filling rate of the magnetic powder in the bonded magnet is increased, the fluidity of the raw material tends to be lowered. Therefore, it is difficult to increase the filling rate of the magnetic powder of the conventional bonded magnet. When the filling rate of the magnetic powder is low, magnet performance of the bonded magnet is deteriorated. Moreover, when the filling rate of the magnetic powder in the bonded magnet is increased, the degree of orientation of the magnetic powder tends to be lowered.

The present disclosure provides an L10-FeNi magnetic powder and a bonded magnet that can improve magnet performance of the bonded magnet. In one aspect of the present disclosure, an L10-FeNi magnetic powder has an average particle size of 50 nm to 1 μm and an average value of sphericity P of 0.9 or more, wherein the sphericity P is defined by the following expression (1).

$$P=Ls/Lr \qquad \text{Expression (1):}$$

In the expression (1), Lr is a perimeter of an L10-FeNi magnetic powder particle on an image of a microscope. In the expression (1), Ls is the perimeter of a perfect circle having the same area as the area of the L10-FeNi magnetic powder particle for which the Lr is calculated.

Use of the above L10-FeNi magnetic powder can improve magnet performance of the bonded magnet.

In another aspect of the present disclosure, a bonded magnet comprises a base material and a magnetic powder dispersed in the base material. The magnetic powder includes the above L10-FeNi magnetic powder and a large-size magnetic powder having an average particle size of 1 to 500 μm. A mass percent of the L10-FeNi magnetic powder in the magnetic powder is 5% or more. This boded magnet has high magnet performance.

Illustrative embodiments of the present disclosure will be described with reference to the drawings.

1. Composition of L10-FeNi Magnetic Powder

L10-FeNi means FeNi having an L10 structure. An L10-FeNi magnetic powder of the present disclosure is a magnetic powder made of L10-FeNi.

An average value of sphericity P in the L10-FeNi magnetic powder (hereinafter referred to as an average value $P_{avg}$) is 0.9 or more. The sphericity P is defined by the following expression (1).

$$P=Ls/Lr \qquad \text{Expression (1):}$$

Figure 1:
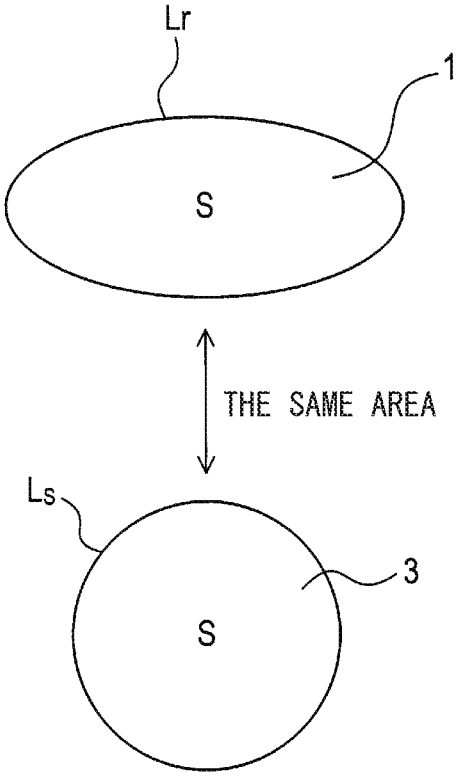
FIG. 1 is an explanatory diagram showing Lr and Ls.

As shown in FIG. 1, Lr in the expression (1) is the perimeter of the L10-FeNi magnetic powder particle 1 on a microscope image. In the above expression (1), Ls is the perimeter of a perfect circle 3 having the same area S as the area S of the L10-FeNi magnetic powder particle 1 on the microscope image for which Lr is calculated.

The average value $P_{avg}$ can be calculated as follows. First, an SEM or TEM image (hereinafter referred to as a microscopic image) in which the L10-FeNi magnetic powder appears is obtained. For each individual L10-FeNi magnetic powder particle on the microscopic image, the sphericity P is calculated based on the expression (1). Next, the average value $P_{avg}$ of the sphericity P over 100 L10-FeNi magnetic powder particles on the microscope image is calculated.

The average particle size $D_{avg}$ of the L10-FeNi magnetic powder of the present disclosure is 50 nm to 1 μm. A measuring method of the average particle size $D_{avg}$ is as follows. First, a microscopic image on which the L10-FeNi magnetic powder appears is acquired. For each individual L10-FeNi magnetic powder particle, the particle size D represented by the following expression (2) is calculated.

$$D=Ls/\pi \qquad \text{Expression (2):}$$

In the expression (2), Ls is the perimeter of a perfect circle having the same area as the area on the microscope image of the L10-FeNi magnetic powder particle for which the particle size D is to be calculated. The average value of the particle size D over 100 L10-FeNi magnetic particles on the microscopic image is defined as the average particle size $D_{avg}$ of the L10-FeNi magnetic powder.

The L10-FeNi magnetic powder of the present disclosure is usable as a magnetic powder contained in a bonded magnet, for example. The L10-FeNi magnetic powder of the present disclosure has a large residual magnetic flux density. Further, when the L10-FeNi magnetic powder of the present disclosure is used as a magnetic powder included in a bonded magnet together with a large-size magnetic powder described later, the fluidity of a raw material of the bonded magnet is unlikely to decrease. Therefore, a filling rate of the magnetic powder in the bonded magnet can be increased. As a result, when the L10-FeNi magnetic powder of the present disclosure is used as a magnetic powder included in a bonded magnet together with a large-size magnetic powder, the residual magnetic flux density of the bonded magnet can be increased. It is noted that the filling rate of the magnetic powder is a ratio of mass of the magnetic powder to total mass of the bonded magnet.

In addition, when the L10-FeNi magnetic powder of the present disclosure is used as a magnetic powder included in a bonded magnet together with a large-size magnetic powder, the degree of orientation of the magnetic powder in the bonded magnet can be increased. The average particle size $D_{avg}$ of the L10-FeNi magnetic powder of the present disclosure is preferably 400 nm to 1 μm. When the average particle size $D_{avg}$ of the L10-FeNi magnetic powder of the present disclosure is 400 nm to 1 μm, the residual magnetic flux density of the bonded magnet is further increased, and the degree of orientation of the magnetic powder in the bonded magnet is further increased.

The L10-FeNi magnetic powder is manufactured by, for example, a method of performing nitriding and denitrification after performing any one or more of a laser irradiation, a thermal plasma and a gas atomizing on FeNi particles serving as a raw material, or the like.

2. Bonded Magnet

Figure 2:
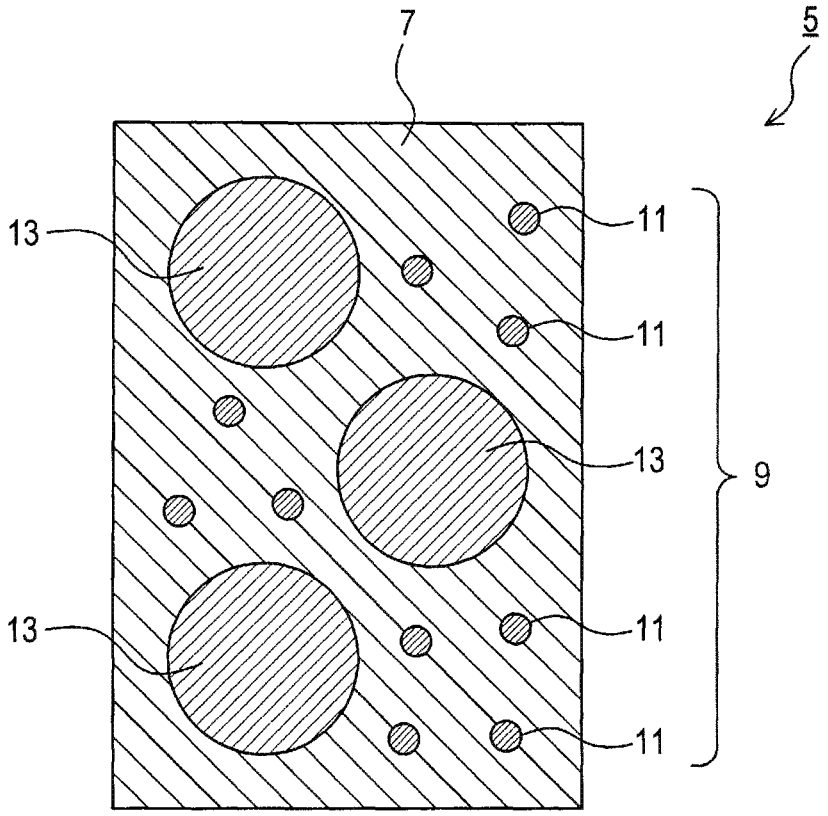
FIG. 2 is an explanatory diagram showing a structure of a bonded magnet.

As shown in FIG. 2, the bonded magnet 5 of the present disclosure includes a base material 7 and a magnetic powder 9 dispersed in the base material 7. The magnetic powder 9 includes the L10-FeNi magnetic powder 11 of the present disclosure and the large-size magnetic powder 13 having an average particle size of 1 μm to 500 μm. A mass percent of the L10-FeNi magnetic powder 11 in the magnetic powder 9 is 5% or more.

The bonded magnet 5 can increase the filling rate of the magnetic powder 9 without great reduction of the fluidity of the raw material of the bonded magnet 5. As a result, the residual magnetic flux density of the bonded magnet 5 can be increased. Moreover, even if the filling rate of the magnetic powder 9 is large in the bonded magnet 5, the degree of orientation of the magnetic powder 9 is large.

Examples of the base material 7 include a resin. Examples of the resin include polyamide, chlorinated polyethylene, ABS, and the like. The large-size magnetic powder 13 is not particularly limited, and an appropriately selected magnet powder is usable as the large-size magnetic powder 13. Examples of the large-size magnetic powder 13 include a rare earth magnetic powder. Examples of the material of the large-size magnetic powder 13 include SmFeN, NdFeB, and SmCo. The average value $P_{avg}$ of the sphericity P in the large-size magnetic powder 13 is preferably in the range of 1.0 to 0.4.

Preferably, the mass percent of the L10-FeNi magnetic powder 11 in the magnetic powder 9 is 10% or more. When 10 mass % or more of the magnetic powder 9 is the L10-FeNi magnetic powder 11, the residual magnetic flux density of the bonded magnet 5 can be further increased. In the bonded magnet 5, the degree of orientation of the magnetic powder 9 can be further increased.

The filling rate of the magnetic powder 9 in the bonded magnet 5 is preferably 80 mass % or more, and more preferably, 90 mass % or more. When the filling rate of the magnetic powder 9 is 80 mass % or more, the residual magnetic flux density of the bonded magnet 5 can be further increased.

3. Method for Manufacturing Bonded Magnet

For example, the bonded magnet of the present disclosure can be manufactured as follows. First, the L10-FeNi magnetic powder of the present disclosure and the base material are mixed at a predetermined mass ratio and vacuum kneading is performed on it and a pre-compound is generated. The base material is, for example, a resin. The temperature in the vacuum kneading is, for example, 140 degrees Celsius. The time of the vacuum kneading is, for example, 10 hours.

Next, the pre-compound is crushed to have a size of, for example, 1 mm or less using a crusher machine or the like, for example. Next, the crushed pre-compound and a large-size magnetic powder are mixed using, for example, a blender and vacuum kneading is performed on it to create a composite compound. The temperature in the vacuum kneading is, for example, 140 degrees Celsius. The time of the vacuum kneading is, for example, 10 hours.

Next, the composite compound is molded into a predetermined shape by a method such as injection molding. Examples of the predetermined shape include a cylinder. Next, a heat treatment is performed while applying a magnetic field in a certain direction to the molded product to perfect the bonded magnet. The temperature of the heat treatment is 180 degrees Celsius, for example. The heat treatment time is, for example, 4 hours.

4. Working Example (4-1) Manufacture of Magnetic Powder C1, C2

FeNi spherical particles A were prepared as a raw material. The FeNi spherical particles A were a special-ordered item made by Nisshin Engineering Inc. The FeNi spherical particles A were produced by a known thermal plasma method. A composition ratio in the FeNi spherical particles A is Fe:Ni=50:50. The units of the composition ratio is at. %.

The following laser irradiation method was performed on the above FeNi spherical particles A.

Laser irradiation method: Suspension was prepared by adding 1 mass % or less of the FeNi spherical particles A to sodium silicate-based thickener aqueous solution and dispersing using an ultrasonic homogenizer. In this suspension, nanoparticles of the FeNi spherical particles A were dispersed in water. The output of the ultrasonic homogenizer was 150 W.

The suspension was irradiated with a YAG pulse laser for 1 to 4 hours to sinter and grow the FeNi spherical particles A. As a result, the FeNi spherical particles B having a particle size of 200 nm to 500 nm were obtained. The wavelength of the YAG pulse laser was 1064 nm. The laser intensity of the YAG pulse laser is 75 mJ/Pulse. The pulse width of the YAG pulse laser is 6 nsec. The repetition frequency of the YAG pulse laser is 10 Hz. A plurality of types of FeNi spherical particles B having different particle sizes were obtained by changing the irradiation time of the YAG pulse laser.

Next, the plurality of types of the FeNi spherical particles B were each subjected to the following nitriding denitrogenation treatment to obtain a plurality of types of FeNi spherical particles C. The nitriding denitrification treatment is a process of making the FeNi spherical particles have an L10 structure.

The nitriding denitrification treatment: nanoparticles of the FeNi spherical particles B were placed on a sample boat. The sample boat was installed in a tubular furnace. The tubular furnace was capable of introducing ammonia gas and hydrogen gas. An atmosphere of the tubular furnace was ammonia gas, and the nitriding treatment was performed at 350 degrees Celsius for 50 hours.

Next, the atmosphere of the tubular furnace was replaced with hydrogen gas, and the denitrification treatment was performed at 300 degrees Celsius for 2 hours. Next, after cooling the tubular furnace, the sample boat was taken out of the tubular furnace. As a result, magnetic powder C provided as the FeNi spherical particles having the L10 structure was obtained.

$P_{avg}$, $D_{avg}$, Ms, and Hc were measured for magnetic powders C1 and C2 among the plurality of types of the magnetic powder C. The results are shown in Table 1. The magnetic powders C1 and C2 differ in $P_{avg}$ and $D_{avg}$ due to the different irradiation times of the YAG laser in the laser irradiation method.

In Table 1, Ms is the magnetization measured by the VSM method. In Table 1, Ms is a value when the external magnetic field is 3T. Hc is a coercivity measured using a VSM after magnetically aligning the compound having a magnetic powder ratio of 10 mass %.

TABLE 1

| Magnetic powder | Material | Manufacturing method | $P_{avg}$ | $D_{avg}$ | Ms (emu/g) | Hc (kOe) |
|---|---|---|---|---|---|---|
| C1 | L10-FeNi | Laser irradiation | 0.96 | 550 nm | 140 | 3.5 |
| C2 | L10-FeNi | Laser irradiation | 0.95 | 400 nm | 142 | 3.1 |
| D1 | L10-FeNi | Thermal plasma | 0.95 | 120 nm | 139 | 1.6 |
| D2 | L10-FeNi | Thermal plasma | 0.90 | 60 nm | 139 | 2.2 |
| D3 | L10-FeNi | Thermal plasma | 0.91 | 30 nm | 137 | 2.0 |
| F1 | L10-FeNi | Gas Atomization | 0.84 | 5.8 μm | 151 | 0.4 |
| F2 | L10-FeNi | Gas Atomization | 0.81 | 3.0 μm | 150 | 0.4 |
| G | NdFeB | Jet mill crushing | 0.43 | 0.8 μm | 98 | 4.5 |
| L | SmFeN | — | 0.62 | 3.5 μm | 133 | 14.0 |

(4-2) Production of Magnetic Powder D1-3

Three types of FeNi spherical particles A having different particle sizes were prepared. The three types of FeNi spherical particles A were each subjected to the nitriding denitrification treatment. This nitriding denitrification treatment was the same as the treatment used for the production of the magnetic powder C. As a result, magnetic powders D1 to D3 made of FeNi spherical particles having an L10 structure were obtained. $P_{avg}$, $D_{avg}$, Ms, and Hc in the magnetic powders D1 to D3 were measured. The results are shown in Table 1 above.

(4-3) Manufacture of Magnetic Powder F1 and F2

As raw materials, two types of FeNi spherical particles E having different particle sizes were prepared. The FeNi spherical particles E was a special-ordered item made by Nissin Engineering Co., Ltd. The FeNi spherical particles E were produced by a known gas atomization method. The composition ratio in the FeNi spherical particles E is Fe:Ni=50:50. The units of the composition ratio is at. %.

The two types of FeNi spherical particles E were each subjected to the nitriding denitrification treatment. This nitriding denitrification treatment was the same as the treatment used for the production of magnetic powder C. As a result, magnetic powders F1 and F2 made of FeNi spherical particles having an L10 structure were obtained. $P_{avg}$, $D_{avg}$, Ms, and Hc in the magnetic powders F1 and F2 were measured. The results are shown in Table 1 above.

(4-4) Production of Magnetic Powder G

An NdFeB sintered magnet was pulverized using a jet mill to produce a magnetic powder G composed of NdFeB. $P_{avg}$, $D_{avg}$, Ms, and Hc in the magnetic powder G were measured. The results are shown in Table 1 above.

(4-5) Production of Large-Size Magnetic Powder L

An large-size magnetic powder L was prepared. The large-size magnetic powder L was a magnetic powder made of SmFeN and was a commercial product. $P_{avg}$, $D_{avg}$, Ms, and Hc in the large-size magnetic powder L were measured. The results are shown in Table 1 above.

(4-6) Manufacture of Bonded Magnets M1 to M8

Bonded magnets M1 to M8 were manufactured as follows. A small-size magnetic powder and a resin were mixed at a predetermined mass ratio and vacuum kneading was performed on it at 140 degrees Celsius for 10 hours to prepare a pre-compound. The small-size magnetic powder was any one of magnetic powders C1, C2, D1 to D3, F1, F2, and G. The correspondence relationship between the bonded magnet and the small-size magnetic powder contained therein is as shown in Table 2 below. Table 2 shows the contents of the small-size magnetic powder contained in the bonded magnets M1 to M8. In each of the bonded magnets M1 to M8, the resin is polyamide.

TABLE 2

| | Contents of contained small-size magnetic powder | | | Bonded magnet evaluation result: Small-size magnetic powder ratio: 10 mass % | | | Small-size magnetic powder ratio: 20 mass % | | |
|---|---|---|---|---|---|---|---|---|---|
| Magnet | type | $P_{avg}$ | $D_{avg}$ | Ms (T) | Mr (T) | Mr/Ms | Ms (T) | Mr (T) | Mr/Ms |
| M1 | C1 | 0.96 | 550 nm | 0.92 | 0.85 | 0.92 | 0.98 | 0.90 | 0.92 |
| M2 | C2 | 0.95 | 400 nm | 0.95 | 0.86 | 0.9 | 1.00 | 0.91 | 0.91 |
| M3 | D1 | 0.95 | 120 nm | 0.84 | 0.76 | 0.9 | 0.88 | 0.78 | 0.88 |

TABLE 2-continued

| | Contents | | | Bonded magnet evaluation result | | | | | |
|---|---|---|---|---|---|---|---|---|---|
| | of contained small-size magnetic powder | | | Small-size magnetic powder ratio: 10 mass % | | | Small-size magnetic powder ratio: 20 mass % | | |
| Magnet | type | $P_{avg}$ | $D_{avg}$ | Ms (T) | Mr (T) | Mr/Ms | Ms (T) | Mr (T) | Mr/Ms |
| M4 | D2 | 0.90 | 60 nm | 0.86 | 0.75 | 0.87 | 0.88 | 0.75 | 0.86 |
| M5 | D3 | 0.91 | 30 nm | 0.82 | 0.70 | 0.85 | 0.78 | 0.66 | 0.84 |
| M6 | F1 | 0.84 | 5.8 μm | 0.90 | 0.70 | 0.78 | 0.94 | 0.71 | 0.75 |
| M7 | F2 | 0.81 | 3.0 μm | 0.86 | 0.73 | 0.85 | 0.90 | 0.71 | 0.79 |
| M8 | G | 0.43 | 0.8 μm | 0.80 | 0.68 | 0.85 | 0.74 | 0.60 | 0.81 |
| M9 | — | — | — | 0.86 | 0.74 | 0.86 | | | |

Next, the pre-compound was crushed into a size of 1 mm or less using a crush machine. Next, the crushed pre-compound and a large-size magnetic powder L were mixed using a blender and vacuum kneading was performed on it at 140 degrees Celsius for 10 hours to prepare a composite compound.

Next, the composite compound was molded to have a cylindrical shape with a diameter of 3 mm and a height of 3 mm by injection molding. Next, heat treatment was performed at 180 degrees Celsius for 4 hours while applying a magnetic field of 1.0 T in the axial direction of the cylinder to perfect the bonded magnets M1 to M8.

In any of the bonded magnets M1 to M8, the mixing ratio of the small-size magnetic powder, the large-size magnetic powder L, and the resin was set so that the filling ratio of the total magnetic powder was 93 mass %. In each of the bonded magnets M1 to M8, there are two types of the total magnetic powder; the mass ratio of the small-size magnetic powder to the total magnetic powder (hereinafter referred to as the small-size magnetic powder ratio) is 10 mass % and 20 mass %.

The manufacturing method is basically the same as that of the bonded magnets M1 to M8, but the bonded magnet M9 is manufactured using only the large-size magnetic powder L as the magnetic powder. Also in the bonded magnet M9, the filling rate of the magnetic powder was 93 mass %.

(4-7) Evaluation of Bonded Magnets M1 to M9

Ms and Mr were measured for each of the bonded magnets M1 to M9. In addition, Mr/Ms was calculated. They are shown in Table 2 above. Mr is the residual magnetization measured using VSM. The magnetization value when the external magnetic field is 0 after application of the external magnetic field of 3 T is Mr. In the bonded magnets M1 to M4, the values of Ms, Mr, and Mr/Ms were in particular large.

Other Embodiments

Although the embodiments of the present disclosure have been illustrated, the present disclosure is not limited to the above illustrated embodiments and can be practiced with various modifications (1) A method for synthesizing the small-size magnetic powder may be other than the method described above.

(2) A plurality of functions of one constituent element in the above embodiment may be realized by a plurality of constituent elements, or one function of one constituent element may be realized by a plurality of constituent elements. Further, a plurality of functions realized by a plurality of constituent elements may be realized by one constituent element, or one function realized by a plurality of constituent elements may be realized by one constituent element. Moreover, a part of a configuration in the above embodiments may be omitted. In addition, at least a part of the configuration of the above embodiments may be added to or replaced with the configuration of another embodiment. In addition, all the aspects included in the technical idea specified from the wording described in the claims are embodiments of the present disclosure.

(3) In addition to the aforementioned L10-FeNi magnetic powder and bonded magnet, the present disclosure can be implemented in various forms such as a system including the L10-FeNi magnetic powder or bonded magnet as its constituent element, a method of manufacturing L10-FeNi magnetic powder, and a method of manufacturing a bonded magnet, and the like.

What is claimed is:

1. A bonded magnet comprising:

a base material; and a magnetic powder dispersed in the base material, wherein the magnetic powder includes:

an L10-FeNi magnetic powder having:

an average particle size of 50 nm to 1 μm; and an average value of sphericity P of 0.9 or more, wherein the sphericity P is defined as P=Ls/Lr, where Lr is a perimeter of an L10-FeNi magnetic powder particle on an image of a microscope, and Ls is a perimeter of a perfect circle that has a same area as the L10-FeNi magnetic powder particle on the image for which Lr is calculated; and a large-size magnetic powder having a different composition from the L10-FeNi magnetic powder and having an average particle size of 1 μm to 500 μm, wherein a mass percent of the L10-FeNi magnetic powder in the magnetic powder is 5% or more.

2. The bonded magnet according to claim 1, the average particle size of the L10-FeNi magnetic powder being in a range from 400 nm to 1 μm.

3. The bonded magnet according to claim 1, wherein:

a filling ratio of the magnetic powder is 80 mass % or more.

4. The bonded magnet according to claim 1, wherein:

the mass percent of the L10-FeNi magnetic powder in the magnetic powder is 10% or more.

* * * * *